US007104239B2

(12) United States Patent
Kawakubo et al.

(10) Patent No.: US 7,104,239 B2
(45) Date of Patent: Sep. 12, 2006

(54) ENGINE CRANKCASE STRUCTURE

(75) Inventors: Hiroyuki Kawakubo, Saitama (JP); Toru Gunji, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 233 days.

(21) Appl. No.: 10/890,114

(22) Filed: Jul. 14, 2004

(65) Prior Publication Data

US 2005/0016488 A1 Jan. 27, 2005

(30) Foreign Application Priority Data

Jul. 22, 2003 (JP) ..... 2003-2777865

(51) Int. Cl.
*F02B 75/06* (2006.01)

(52) U.S. Cl. ..... 123/192.2; 123/196 A; 123/196 AB; 123/192.1

(58) Field of Classification Search ..... 123/192.2, 123/196 A, 196 AB, 192.1
See application file for complete search history.

(56) References Cited

U.S. PATENT DOCUMENTS 5,305,656 A 4/1994 Kamiya et al.
2004/0173176 A1* 9/2004 Kawakubo et al. ..... 123/192.1
2004/0200658 A1* 10/2004 Kawakubo et al. ..... 180/309

FOREIGN PATENT DOCUMENTS

JP 2000-310286 A 11/2000
JP 2002 122028 A 4/2002
JP 2002 127977 A 5/2002
JP 2002 201923 A 7/2002

* cited by examiner

*Primary Examiner*—Tony M. Argenbright
*Assistant Examiner*—Katrina Harris
(74) *Attorney, Agent, or Firm*—Birch, Stewart, Kolasch & Birch, LLP

(57) ABSTRACT

To miniaturize an engine, to concentrate heavy masses and to reduce friction loss of a balancer. An engine crankcase structure in which a crankcase is vertically partitioned into an upper case and a lower case, each journal supporter is formed in the upper case and in the lower case so that the rotational axis of a crankshaft is located on a partition face of the crankcase in parallel with a direction of the width of the body. The crankshaft is supported so that the crankshaft can be rotated. An oil filter is directly attached to the lower case. An oil cooler and a secondary balancer are arranged in the front of the lower case.

16 Claims, 8 Drawing Sheets

ENGINE CRANKCASE STRUCTURE

CROSS-REFERENCE TO RELATED APPLICATIONS

This nonprovisional application claims priority under 35 U.S.C. § 119(a) on Patent Application Ser. No. 2003-277865, filed in Japan on Jul. 22, 2003, the entirety of which is incorporated herein by reference.

BACKGROUND OF THE INVENTION

1. Field of the Invention

The present invention relates to the crankcase structure of an engine. In particular, the present invention relates to the crankcase structure of an engine provided with a balancer.

2. Description of Background Art

In the background art, some engines mounted in a vehicle such as a motorcycle are provided with a secondary balancer. The secondary balancer is provided with a balancer shaft parallel to the crankshaft and is configured so that secondary engine vibration is effectively reduced by rotating the secondary balancer by two times the number of revolutions of the crankshaft (see JP-A-2000-310286). A balancer according to the above background art is configured by one or two shafts, and the layout is determined in consideration of a relation between the balancer and each part of the engine.

In the above-mentioned engine, the balancer is arranged in the front of the crankcase. However, in the case of a motorcycle for example, an exhaust pipe connected to the cylinder head is arranged so that the exhaust pipe passes the front side and the downside of the crankcase. Accordingly, there are many limitations on the balancer layout. In addition, an oil cooler and an oil filter are often arranged in the front of the crankcase and these including the balancer are required to be properly laid out.

SUMMARY OF THE INVENTION

The present invention provides a crankcase structure for an engine in which the engine is miniaturized, heavy masses are concentrated and friction loss is reduced by the balancer.

According to a first aspect of the present invention, the crankcase structure of an engine includes a crankcase (for example, a crankcase 41 in an embodiment) vertically partitioned into an upper case (for example, an upper case 57 in the embodiment) and a lower case (for example, a lower case 58 in the embodiment). A journal supporter (for example, a journal supporter 71 in the embodiment) is formed in the upper case and in the lower case so that the rotational axis of the crankshaft (for example, a crankshaft 60 in the embodiment) is arranged in parallel with a direction of the width of the body on a partition face of the crankcase. The crankshaft is supported so that it can be rotated. In addition, the crankcase structure includes an oil filter (for example, an oil filter 134 in the embodiment) directly attached to the lower case and an oil cooler (for example, an oil cooler 97 in the embodiment) and a balancer (for example, a secondary balancer 85 in the embodiment) are arranged in the front of the lower case.

According to the above-mentioned configuration, the oil filter, the oil cooler and the balancer are arranged collectively in the lower case of the crankcase. Accordingly, the center of gravity of the engine can be lowered, the engine can be miniaturized, and heavy masses can be concentrated. In addition, the oil filter and the oil cooler are separately arranged. Therefore, a degree of the freedom of the layout is enhanced, compared with a case that an oil cooler and an oil filter are arranged in series.

According to a second aspect of the present invention, the configuration of an oil passage is simplified by arranging the oil cooler and the balancer at the back of the exhaust pipe (for example, an exhaust pipe 44 in the embodiment) that passes the front side of the crankcase, compared with the situation where a water-cooled oil cooler for example is arranged in front of an exhaust pipe and is made to communicate with a crankcase via an oil hose, and in the situation where the water-cooled oil cooler. Furthermore, the configuration of the cooling water passage is also simplified. In addition, it is suitable for the drive of the balancer and the concentrated arrangement of each part that the balancer be arranged in the front of the lower case without being apart from the crankcase.

According to a third aspect of the present invention, the balancer is arranged in front of a fastening bolt (for example, a fastening bolt 155 in the embodiment) for fastening each journal supporter on the side of the upper case and on the side of the lower case. Accordingly, the balancer can be arranged in the vicinity of a partition face of the crankcase, thereby avoiding the circumference of the journal supporter of the lower case. Specifically, the balancer can be arranged in a part near to the upside of the lower case. Therefore, the consumption of engine oil by the balancer is minimized.

According to a fourth aspect of the present invention, an oil filter is directly attached to the side of the lower case. Accordingly, the oil filter can be detached in a direction of the width of the body from the side end of an engine. Furthermore, even if an exhaust pipe of the engine is arranged in front of the crankcase, the exhaust pipe does not prevent the oil filter from being detached.

The maneuverability of a vehicle and a degree of the freedom of the layout of the body can be enhanced by lowering a center of gravity of the engine, miniaturizing the engine and concentrating heavy masses. In addition, manufacturing time and manufacturing cost can be reduced by the simplification of the configuration of parts. Furthermore, friction loss by the consumption of engine oil by the balancer is reduced, the output of the engine can be enhanced and fuel economy can be reduced. When the oil filter is detached, the exhaust pipe does not prevent it and the maintainability can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will now be described with reference to the accompanying drawings.

Figure 1:
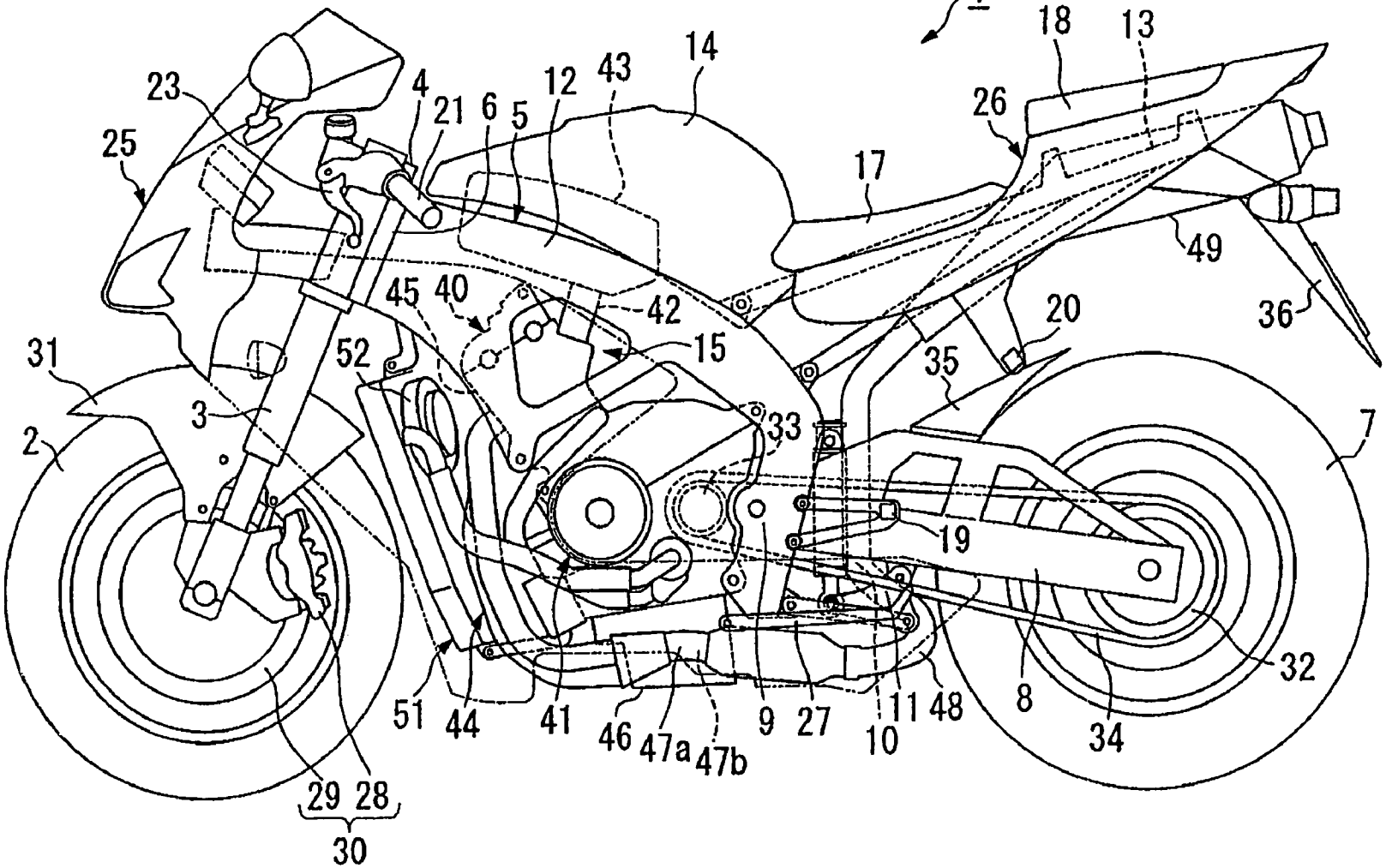
FIG. 1 is a side view when a motorcycle equivalent to an embodiment of the invention is viewed from the left side of the body.

As shown in FIG. 1, a front fork 3 that supports a front wheel 2 of a motorcycle 1 is supported by a head pipe 6 provided on the front end of a body frame 5 via a steering stem 4 so that the front fork can be steered. A rear fork 8 that supports a rear wheel 7 is supported by a pivot part 9 provided on an intermediate part of the body frame 5 and the body of an engine 15 so that the rear fork can be vertically moved. The upper end of a rear cushion 10 is attached in the vicinity of the pivot part of the rear fork 8. The lower end of the rear cushion 10 is attached to a lower part of the pivot part 9 and a lower part of the body of the engine 15 via a link mechanism 11.

A main frame 12 of the body frame 5 extends backward and downward from an upper side of the head pipe 6 on the right side and on the left side. A rear end is curved downward and ranges to the pivot part 9. A seat frame 13 of the body frame 5 is connected to the rear of the main frame 12. A fuel tank 14 is arranged on an upper side of the main frame 12 and the body 15 of the water-cooled in-line four-cylinder engine 15 (also referred to as a cross-compound four-cylinder engine) is arranged under the main frame 12.

A seat for a rider 17 and a pillion seat for a rear passenger 18 are supported by each seat frame 13 at the back of the fuel tank 14. Right and left steps for the rider 19 are attached to the rear of the right and left pivot parts 9 via step holders. Furthermore, a step for the rear passenger 20 is attached to lower sides of the right and left seat frames 13 via each the step holders.

Figure 2:
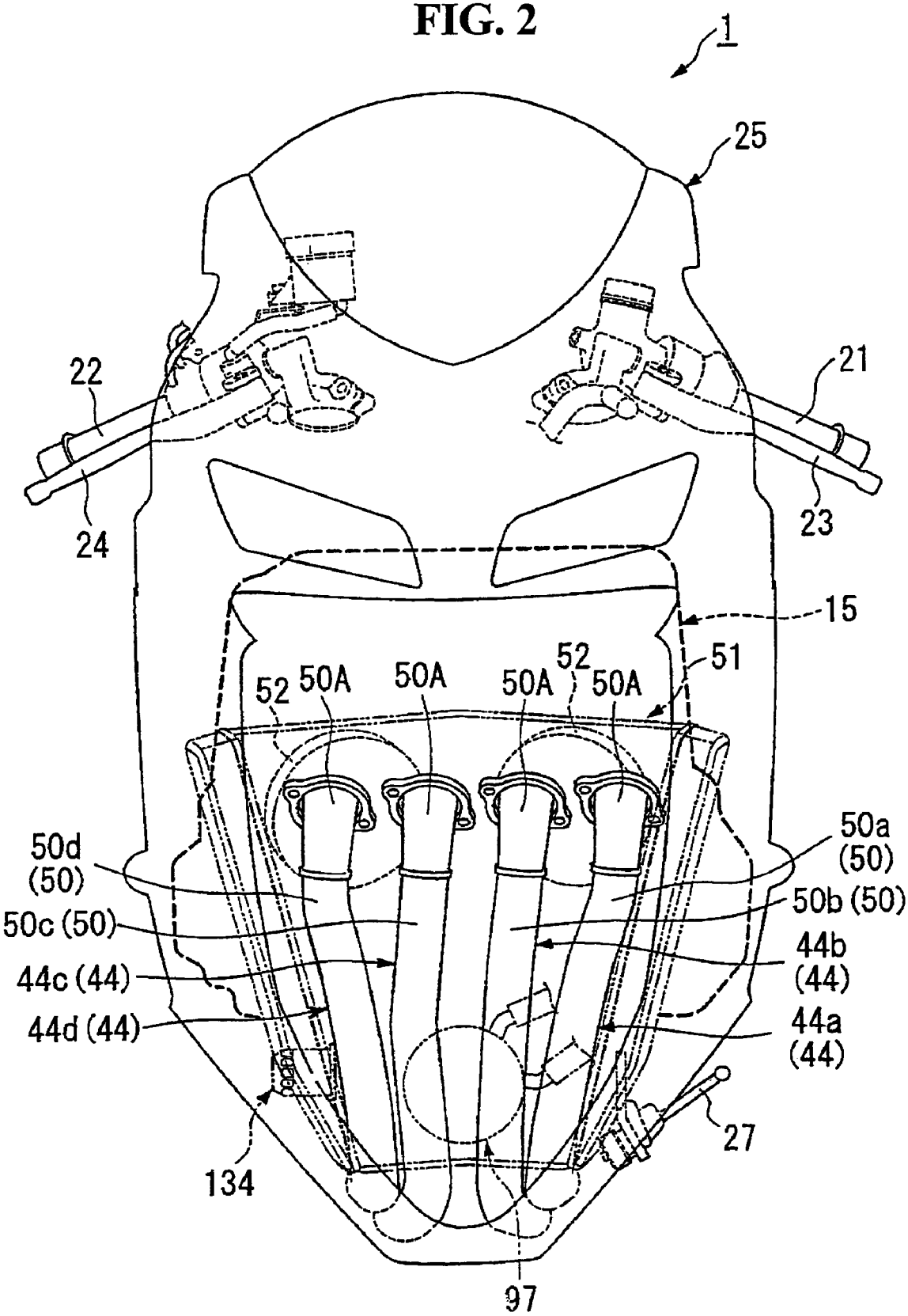
FIG. 2 is a front view showing the motorcycle.

Referring to FIG. 2, a pair of right and left handlebars 21, 22 are attached to the upper end of the front fork 3. A clutch lever 23 is arranged in front of the left handlebar 21 and a brake lever 24 is arranged in front of the right handlebar 22.

A brake caliper 28 is attached to the lower end of the front fork 3 and a brake rotor 29 corresponding to the brake caliper 28 is attached to the front wheel 2. The above structure forms a front braking device 30. A rear braking device having a similar configuration to that of the front braking device 30 is provided on the right side of the rear wheel 7.

A rear sprocket 32 is attached to the left side of the rear wheel 7, a drive chain 34 is wound on the rear sprocket 32 and a drive sprocket 33 arranged on the rear left side of the body of the engine 15. This structure allows transmission of a driving force of the engine to the rear wheel 7.

The front of the body of the motorcycle 1 is covered with a front cowl 25 and the circumference of the seat frame 13 is covered with a rear cowl 26. A side stand 27 that can be stored is arranged in a lower part on the left side of the body frame 5. The motorcycle 1 can be supported by using the side stand 27 in a state in which the motorcycle stands with the body inclined on the left side.

The body of a cylinder 40 of the body of the engine 15 is arranged above a crankcase 41 in a state in which the body of the cylinder is rather inclined forward. A throttle body 42 corresponding to each cylinder is connected to the rear of the body of the cylinder 40 and each throttle body 42 is connected to an air cleaner case 43 arranged between the main frame 12 and the fuel tank 14. An exhaust pipe 44 corresponding to each cylinder is connected to the front of the body of the cylinder 40. The exhaust pipe 44 is curved downward after it is extended forward from the front wall 45 of the body of the cylinder 40. The exhaust pipe 44 also extends to the back of the body of the engine 15, passing the front side and a lower side of the crankcase 41.

The exhaust pipe 44 extends forward from the front wall 45 of the body of the cylinder 40. The exhaust pipe 44 then curves downward and extends backward after it extends downward, passing the body of the cylinder 40 and the front side of the crankcase 41. The exhaust pipe is arranged below the crankcase 41. Assuming that four exhaust pipes 44*a*, 44*b*, 44*c*, 44*d* are arranged in order from the left side, the exhaust pipes 44*a* and 44*b* arranged below the crankcase 41 extend backward and are united together, avoiding the oil pan 46, which is swollen downward from a lower part of the crankcase 41 on the left side, to form a secondary exhaust pipe 47*a*. Similarly, the exhaust pipes 44*c* and 44*d* extend backward and are united together, avoiding the oil pan 46 on the right side, to form a secondary exhaust pipe 47*b*.

Each secondary exhaust pipe 47*a* and 47*b* is united at the back of the oil pan 46 to form a collecting pipe 48. The collecting pipe 48 is arranged upward at the back of the pivot part 9, and is connected to a silencer 49 supported by the seat frame 13. A curved part 50A on the side of the end connected to the body of the cylinder 40 of the exhaust pipe 44 and a downward extended part 50, which extends downward from the curved part 50A, are configured separately. The curved part 50A and the downward extended part 50 are bonded and united by laser welding, for example.

Assuming that downward extended parts corresponding to each exhaust pipe 44*a*, 44*b*, 44*c* and 44*d* are 50*a*, 50*b*, 50*c*, 50*d*, the downward extended parts 50*a* and 50*d* of the exhaust pipes 44*a*, 44*d* are bent like a crank so that the lower part is located inside the upper part in a direction of the width of the body. The exhaust pipe 44*a* is arranged so that the exhaust pipe comes in contact with the inside exhaust pipe 44*b* below the crankcase 41 and extends backward. Similarly, the exhaust pipe 44*d* is arranged so that the exhaust pipe comes in contact with the inside exhaust pipe 44*c* below the crankcase and extends backward. In addition, the outside exhaust pipes 44*a* and 44*d* in the direction of the width of the body are located above the inside exhaust pipes 44*b* and 44*c*. Therefore, a body banking angle and space at the rider's feet are secured.

A radiator 51 is arranged in front of the exhaust pipe 44 in a state in which the radiator is rather inclined forward like the body of the cylinder 40. The radiator 51 is a round type the front side of which is concavely curved and is vertically provided from the upside of the body of the cylinder 40 to the downside of the crankcase 41. A pair of right and left radiator fans 52 is attached on the upper back side of the radiator 51. To secure the body banking angle and the space at the rider' feet, the radiator 51 is narrowed in the direction of the width of the body toward the downside.

Figure 3:
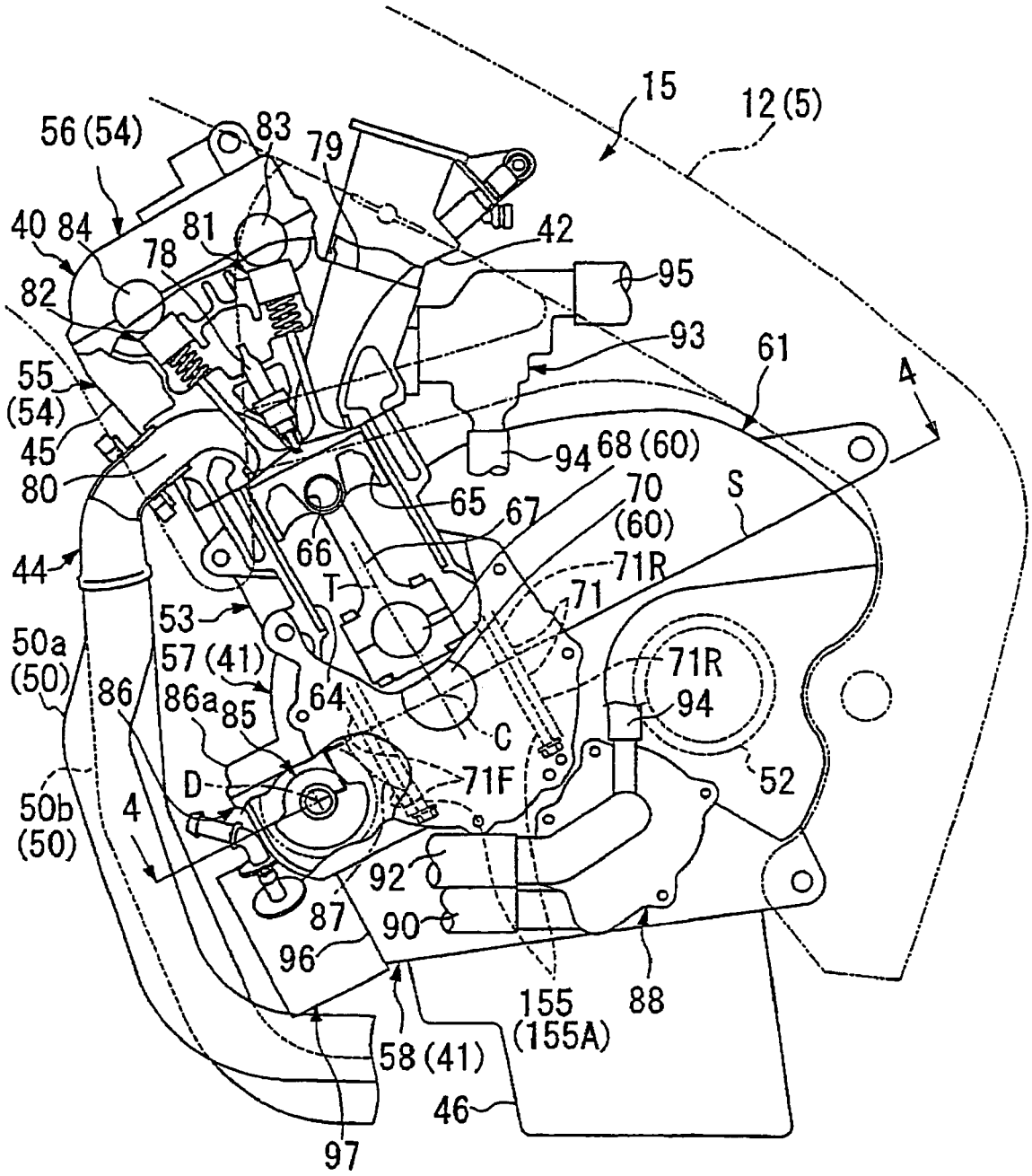
FIG. 3 is a side view showing the circumference of an engine shown in FIG. 1.

As shown in FIG. 3, the body of the engine 15 is provided with a cylinder block 53, which is a main component of the body of the cylinder 40, a cylinder head 54 and the crankcase 41. The cylinder head 54 is partitioned into the body of a head 55 and a head cover 56. The crankcase 41 is partitioned into an upper case 57 and a lower case 58. The upper case 57 and the cylinder block 53 are integrated. The oil pan 46 is attached to a lower part of the lower case 58. The cylinder head 54, the cylinder block 53, the upper case 57 and the lower case 58 are made of a cast aluminum alloy.

Figure 4:
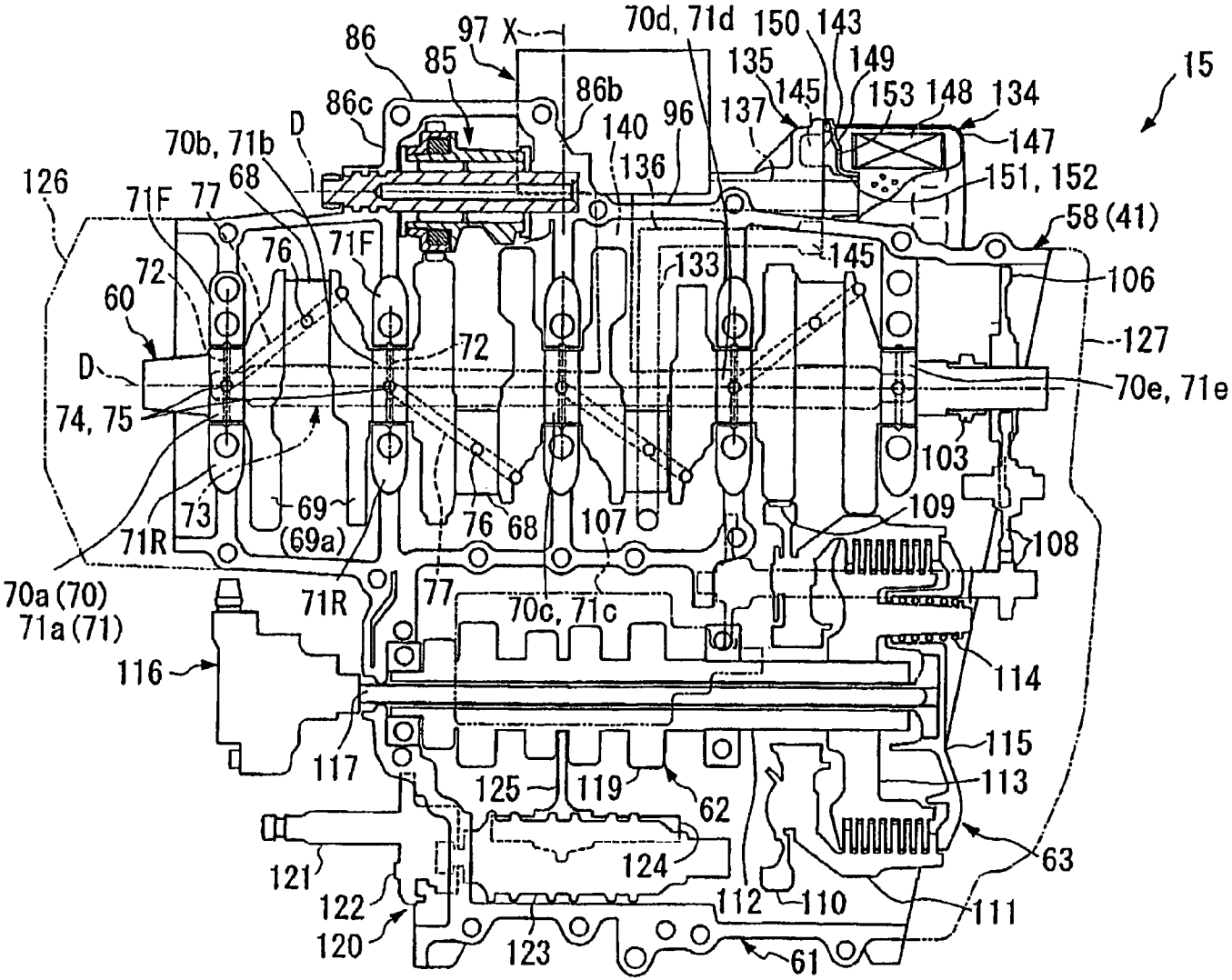
FIG. 4 is a sectional view viewed along a line 4—4 in FIG. 3.

Referring to FIG. 4, a crankshaft 60 having an axis C parallel to the direction of the width of the body is arranged in the crankcase 41. A transmission case 61 extends to the rear of the crankcase 41. A transmission 62 and a clutch mechanism 63 are arranged in the transmission case 61. A partition face S on which the upper case 57 and the lower case 58 of the crankcase 41 are partitioned is inclined so that the face is substantially perpendicular to the body of the cylinder 40. The partition face S is located at a higher position on the rear side. The axis C of the crankshaft 60 is arranged on the partition face S, i.e., arranged in the plane of the partition face S.

In the cylinder block 53, four cylinders 64 are arranged in the direction of the width of the body. A piston 65 is fitted into each cylinder 64 so that the piston can slide. A connecting rod 67 is rotatably coupled to each piston 65 via a piston pin 66. A big end of the connecting rod 67 is rotatably coupled to a crankpin 68 of the crankshaft 60. Each crankpin 68 is supported by a pair of crank arms 69 and a counterweight 69*a* is integrated with a part on the reverse side of the crankpin 68 of each crank arm 69.

Five journals 70 provided on the axis C on the sides of both ends of the crankshaft 60 and between each crank arm 69 are supported by journal supporters 71 provided on the upper case 57 and the lower case 58 so that the journals can be rotated. The reciprocating motion of the piston 65 is converted to rotational motion with the axis C as the center. In this case, each journal 70*a*, 70*b*, 70*c*, 70*d* and 70*e* are arranged in order from the left side.

Each journal supporter 71 protrudes from the upper case 57 and the lower case 58 to the partition face S of the crankcase 41 and is flat in a direction of the axis C. A semicircular cylindrical face matched with the journal 70 is formed on each journal supporter 71. The front 71F of the cylindrical face and the rear 71R are mutually confronted on the partition face S when the upper case 57 and the lower case 58 are assembled. In this case, the journal supporters 71*a*, 71*b*, 71*c*, 71*d* and 71*e* correspond to each journal 70*a*, 70*b*, 70*c*, 70*d* and 70*e*, respectively.

Figure 7:
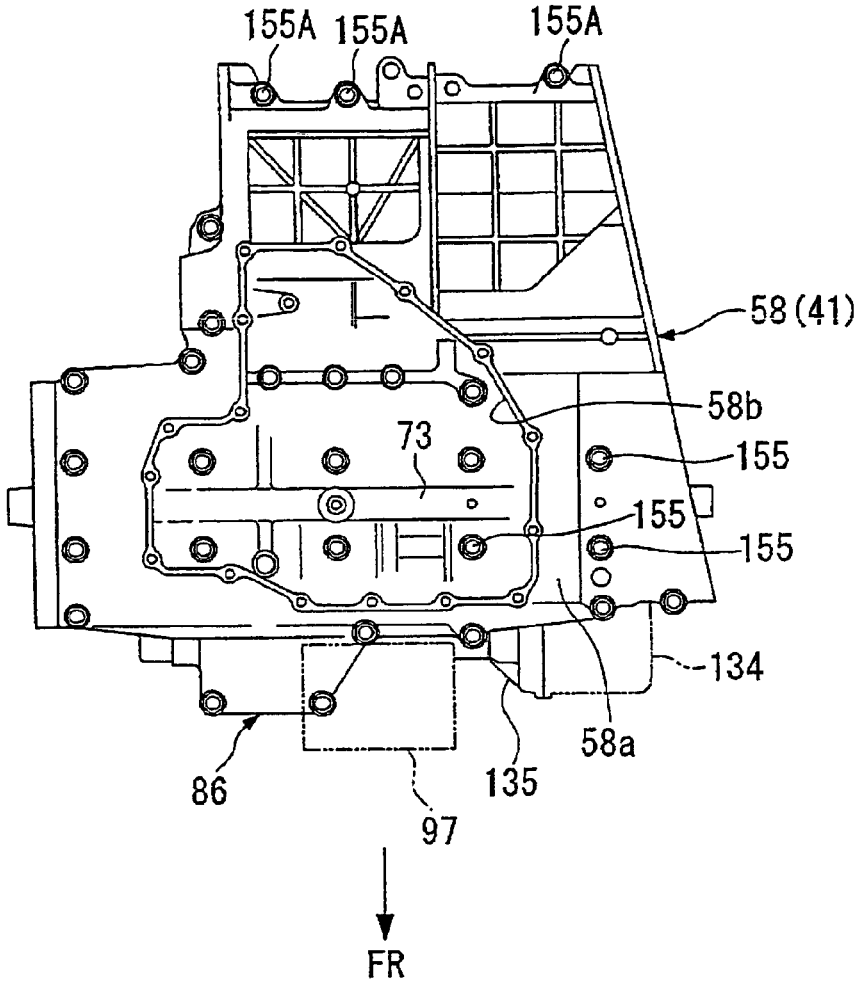
FIG. 7 is a bottom view showing a lower case of the engine.

As shown in FIG. 7, a crankcase fastening bolt 155A for assembling the upper case 57 and the lower case 58 is suitably arranged in the crankcase 41. Out of these crankcase fastening bolts 155A, it is a fastening bolt 155 for fastening each journal supporter 71 on the side of the upper case 57 and on the side of the lower case 58 that is arranged so that the fastening bolt pierces the front 71F of the cylindrical part and the rear 71R of each journal supporter 71. "FR" in FIG. 7 shows the front side of the body.

An insertion hole for inserting a lower part of the fastening bolt 155 is formed in a direction in which the insertion hole is substantially perpendicular to the partition face S in the front 71F of the cylindrical face and the rear 71R of the lower case 58. A tapped hole corresponding to the fastening bolt 155 inserted into each insertion hole of the lower case 58 from the lower side is formed in the front 71F of the cylindrical face and the rear 71R of the upper case 57 (see FIG. 3). In a state in which the upper case 57 and the lower case 58 are assembled, each journal supporter 71 supports the journal 70 of the crankshaft 60 so that the journal can be rotated. Each bolt 155A including the fastening bolt 155 is made of steel having a Young's modulus which is higher than that of an aluminum alloy, which is the material of the crankcase 41 and other parts of the engine.

The lower case 58 is provided with a lower case lower wall 58*a* in a position equivalent to a predetermined depth on the lower side from the partition face S. The lower case 58 is also provided with a lower opening 58*b* open on the partition face S and along the periphery of the oil pan 46 on the lower case lower wall 58*a*. The circulation of engine oil in the oil pan 46 and the in the body of the engine 15 is enabled by the lower opening 58*b* and the fastening of the fastening bolt 155 onto the journal supporter 71 is enabled.

Each fastening bolt 155 for fastening the journal supporters 71*a* and 71*e* for supporting both end sides of the crankshaft 60 is directly inserted from the insertion hole open to the lower surface of the lower case lower wall 58*a*. Each fastening bolt for fastening three journal supporters 71*b*, 71*c*, 71*d* located inside these journal supporters is inserted from the insertion hole open to the lower opening 58*b*. Furthermore, each fastening bolt is fastened onto the upper case 57. In this case, a lower part of the journal supporter 71 of the lower case 58 and the head of the fastening bolt 155 are located on the downside by the depth of the lower case 58 from the partition face S.

An oil groove 72 is formed in the substantial center in the direction of the axis C on the cylindrical face of each journal supporter 71 of the upper case 57 and the lower case 58 (in FIG. 4, only the oil grooves on the side of the lower case 58 are shown). A main oil gallery 73 extends in the direction of the width of the body between the vicinities of both ends of the crankshaft 60. The main oil gallery 73 is formed on the lower side of the crankshaft 60 in the lower case 58. The main oil gallery 73 and the oil groove 72 of each journal supporter 71 communicate via an oil path 74. Engine oil is supplied from the main oil gallery 73 to each journal supporter 71 via the oil path 74 and the oil groove 72.

An oil hole 75 that pierces a part opposite to the oil groove 72 of the journal supporter 71 in a direction of the diameter is formed on the journal 70 of the crankshaft 60. Similarly, an oil hole 76 that pierces the substantial center in the axial direction of the crankpin in the direction of the diameter is formed on the crankpin 68. Each oil hole 75 and 76 communicates via a communicating oil hole 77 diagonally made for the axis C from the side of the crank arm 69. A part of the engine oil supplied to the oil groove 72 is supplied to the peripheral face of each crankpin 68 via the oil hole 75, the communicating oil hole 77 and the oil hole 76. A steel ball is press-fitted into an opening of the communicating oil hole 77 formed on the crank arm 69 to close the opening.

As shown in FIGS. 3 and 4, a single-shaft secondary balancer 85 is arranged in a part on the slightly left side of the center in the direction of the width of the body in the front of the crankcase 41. "X" in FIG. 4 identifies a center line in the direction of the width of the body. The secondary balancer 85 is rotated by twice the number of revolutions of the crankshaft 47 to reduce the secondary vibration of the engine. The secondary balancer 85 has an axis D parallel to the axis C and is housed in a housing 86 formed by swelling a part of the front wall 96 of the lower case 58 forward. A balancer drive gear 87 for rotating the secondary balancer 85 is provided on the periphery of the left crank arm 69 that supports the second crankpin 68 from the left side and the counterweight 69*a* integrated with it.

The front wall 96 of the lower case 58 is provided so that the front wall is substantially perpendicular to the partition face S. The upper side of the housing 86 is in contact with the partition face S. That is, the secondary balancer 85 is arranged in the vicinity of the partition face S on which the upper side of the lower case 58 is located. The reason is that the axis D of the secondary balancer 85 is arranged in front of the journal supporter 71 of the lower case and the fastening bolt 155 to avoid these parts. A part of the upper limb on the partition face S of the front wall 96 of the lower case 58 is changed forward corresponding to the shape of the housing 86 and an upward opening by the change of the front wall 96 is closed by a cover 86*a* formed in the upper case 57.

A water pump 88 is arranged on the left side of the lower case 58. The water pump 88 is arranged coaxially with an oil pump 89 described later (see FIG. 5) in the direction of the width of the body and is operated according to the rotation of the crankshaft 60 together with the oil pump 89. A radiator hose on the outflow side 90 communicating with a tank on the outflow side of the radiator 51 and a cooling water hose 92 communicating with the water jacket of the cylinder head 54 and the cylinder block 53 are connected to the water pump 88 (see FIG. 1). A thermostat 93 is connected to the rear of the cylinder head 54 and a bypass hose 94 is arranged between the thermostat 93 and the water pump 88. A radiator hose on the inflow side 95 communicating with a tank on the inflow side of the radiator 51 is connected to an outlet for cooling water of the thermostat 93.

When the water pump 88 is operated, cooling water led from the radiator 51 via the radiator hose on the outflow side is taken in the body of the cylinder 40 via the cooling water hose 92. The cooling water cools each part and is repeatedly circulated in the body of the cylinder 40 via the same path after the cooling water is returned to the radiator 51 via the thermostat 93 and the radiator hose on the inflow side 95. At this time, if the temperature of the cooling water that passes the thermostat 93 is a fixed temperature or cooler, the cooling water is sent to the water pump 88 via the bypass hose 94 from the thermostat 93 and is circulated without passing the radiator 51. When the temperature of cooling water that passes the thermostat 93 exceeds the fixed temperature, the radiator fan 52 is operated to forcedly cool the cooling water.

A water-cooled oil cooler 97 is attached to the front side of the front wall 96 of the lower case 58. The oil cooler 97 is arranged next to the right lower side of the housing 86 of the secondary balancer 85, that is, on the slightly right side of the center in the direction of the width of the body in the front of the crankcase 41. The oil cooler 97 shares cooling water with the body of the engine 15. The cooling water is taken from a branch pipe and a hose (both not shown) provided along the cooling water hose 92, and is returned to the water pump 88 via a branch pipe and a hose (both not shown) provided along the radiator hose on the outflow side 90.

Figure 5:
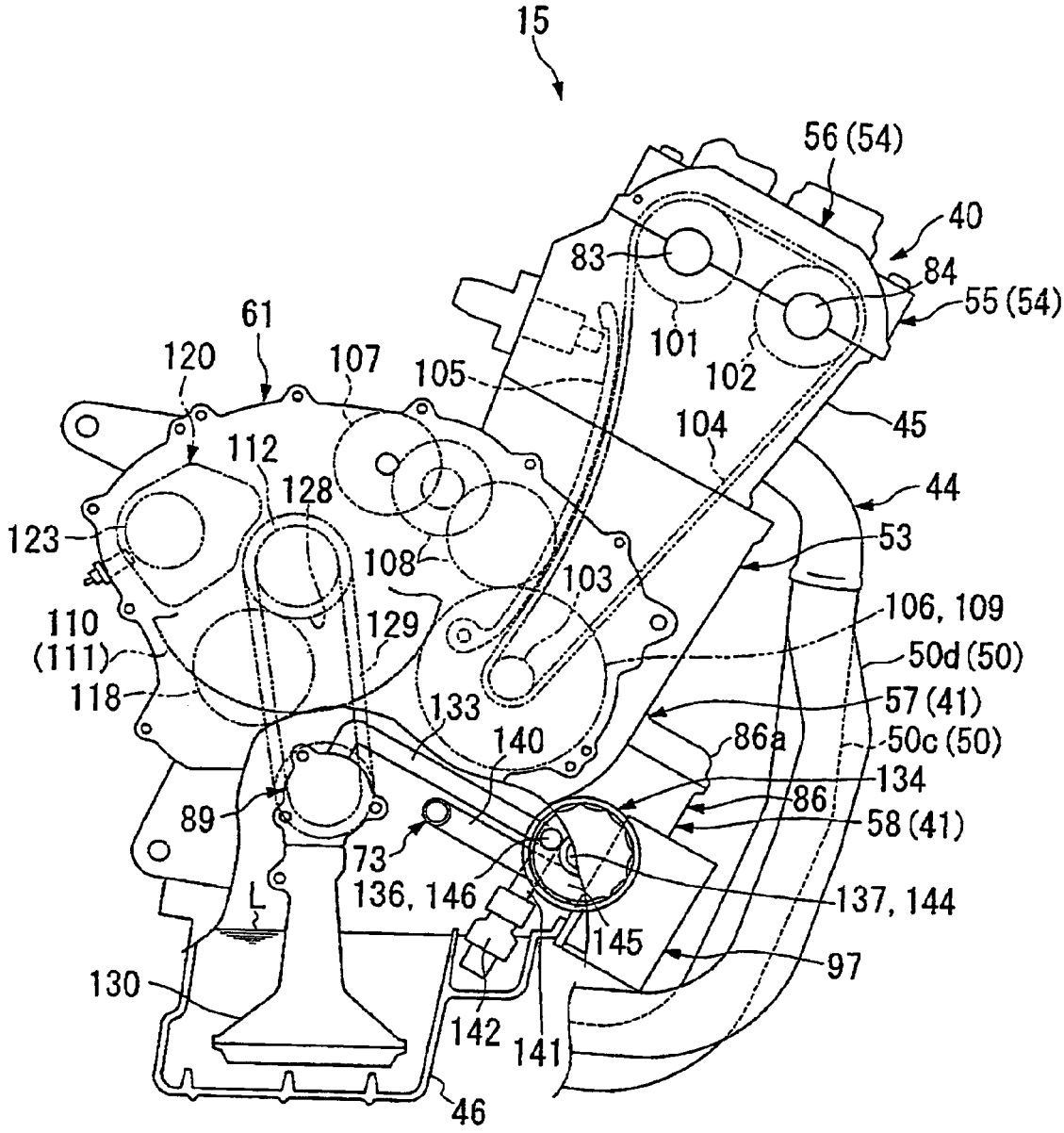
FIG. 5 is a side view when the circumference of the engine of the motorcycle is viewed from the right side of the body.

As shown in FIG. 5, each cam sprocket 101, 102 is fixed to the right end of each camshaft 83 and 84. A cam chain 104 is wound on these cam sprockets 101 and 102 and a chain sprocket 103 fixed to the right end of the crankshaft 60. Each camshaft 83 and 84 is rotated according to the rotation of the crankshaft 60, and each intake valve 81 and each exhaust valve 82 are opened or closed. The play of the cam chain 104 is inhibited by a single-type cam chain tensioner 105.

Referring to FIG. 4, a starter motor driven gear 106 is coupled to the outside in the width direction of the body of the chain sprocket 103 at the right end of the crankshaft 60 on the axis C via a one-way clutch (not shown). A starter motor 107 is arranged in an upper part of the transmission case 61 and the crankshaft 60 is rotated only in a direction in which the engine is started via a starter gear train 108 engaged with its drive shaft by the starter motor 107.

A primary drive gear 109 is provided on the periphery of the crank arm 69 on the left side that supports the crankpin 68 at the end of the right side and the counterweight 69*a* integrated with the crank arm, and is engaged with a primary driven gear 110 of the clutch mechanism 63 arranged on the right side of the transmission case 61. The clutch mechanism 63 is a so-called multiple disc clutch provided with the primary driven gear 110, a clutch outer 111 rotated integrally with it, a clutch center 113 housed in the clutch outer 111 and rotated integrally with a main shaft 112 of the transmission 62 and plural friction plates 111*a*, 113*a* on the side of the clutch outer 111 and on the side of the clutch center 113.

A pressure plate 115 pressed by plural clutch springs 114 is attached to the clutch center 113. The pressure plate 115 mutually presses both of the friction plates 111*a* and 113*a*. Therefore, the clutch mechanism 63 is turned to a state in which it can transmit power. A clutch release 116 arranged on the left side of the transmission case 61 is operated by the operation of the clutch lever 23. Both of the friction plates 111*a* and 113*a* are separated by moving the pressure plate 115 via a rod 117 inserted into the main shaft 112 against the pressure of the clutch spring 114. Power transmission by the clutch mechanism 64 is then turned off.

The transmission 62 is provided with the main shaft 112 and a counter shaft 118 are respectively arranged in parallel with the axis C and supported by the transmission case 61 so that the shafts can be rotated. A transmission gear train 119 is respectively provided on both shafts 112 and 118 and is mutually engaged via splines. The main shaft 112 is arranged in a coaxial position with the clutch mechanism 63. The clutch center 113 of the clutch mechanism 63 is fitted and fixed to the right end of the main shaft 112. The main shaft 112 and the counter shaft 118 are both hollow. Engine oil flows through the hollow part and is supplied to each sliding face, the transmission gear train 119 and the clutch mechanism 63 via oil holes.

The driving force of the engine is transmitted to the main shaft 112 of the transmission 62 via the primary drive gear 109, the primary driven gear 110 and the clutch mechanism 63 from the crankshaft 60. The driving force is then transmitted to the counter shaft 118 at a predetermined reduction gear ratio via the transmission gear train 119, and is further transmitted to the rear wheel 7 via the drive chain 34 from the drive sprocket 33 fixed to the left end of the counter shaft 118.

The reduction gear ratio of the transmission 62 is switched and controlled by a change mechanism 120 arranged in the rear of the transmission case 61. The change mechanism 120 is provided with a ratchet 122 having a change spindle 121, a shift drum 123, plural (only one is shown) shift forks 125 installed on a shift fork shaft 124 and suitably fitted to the shift drum 123 and the transmission gear train 119 of the transmission 62. A change pedal (not shown) is coupled to the end of the change spindle 121 that protrudes from the transmission case 61. The change spindle 121 is rotated by a fixed angle by the operation of the change pedal. The shift drum 123 is rotated via the ratchet 122. Furthermore, the engagement of each shift fork 125 with the transmission gear train 119 is changed and the reduction gear ratio is changed.

An AC generator (not shown) provided with a rotor integrally rotated with the crankshaft 60 and a stator supported by a generator cover 126 is provided to the left end of the crankshaft 60. An ignition timing detection mechanism (not shown) provided with a pulser rotor integrally rotated with the crankshaft and a pulse generator supported by a point cover 127 is provided to the right end of the crankshaft 60.

The oil pump 89 is arranged in the lower part of the crankcase 41. The oil pump 89 is provided for force-feeding engine oil to suitable locations in the body of the engine 15. The oil pump 89 is linked to an oil pump drive sprocket 128 engaged with the main shaft 112 and rotated together with the primary driven gear 110 via a chain 129. The operation is started according to the rotation of the crankshaft 60. Engine oil L is reserved in the oil pan 46 fixed to the lower part of the lower case 58. An oil strainer 130 is dipped in the reserved engine oil L. The oil level of the engine oil L is located in the vicinity of the upper edge of the oil pan 46.

Figure 6:
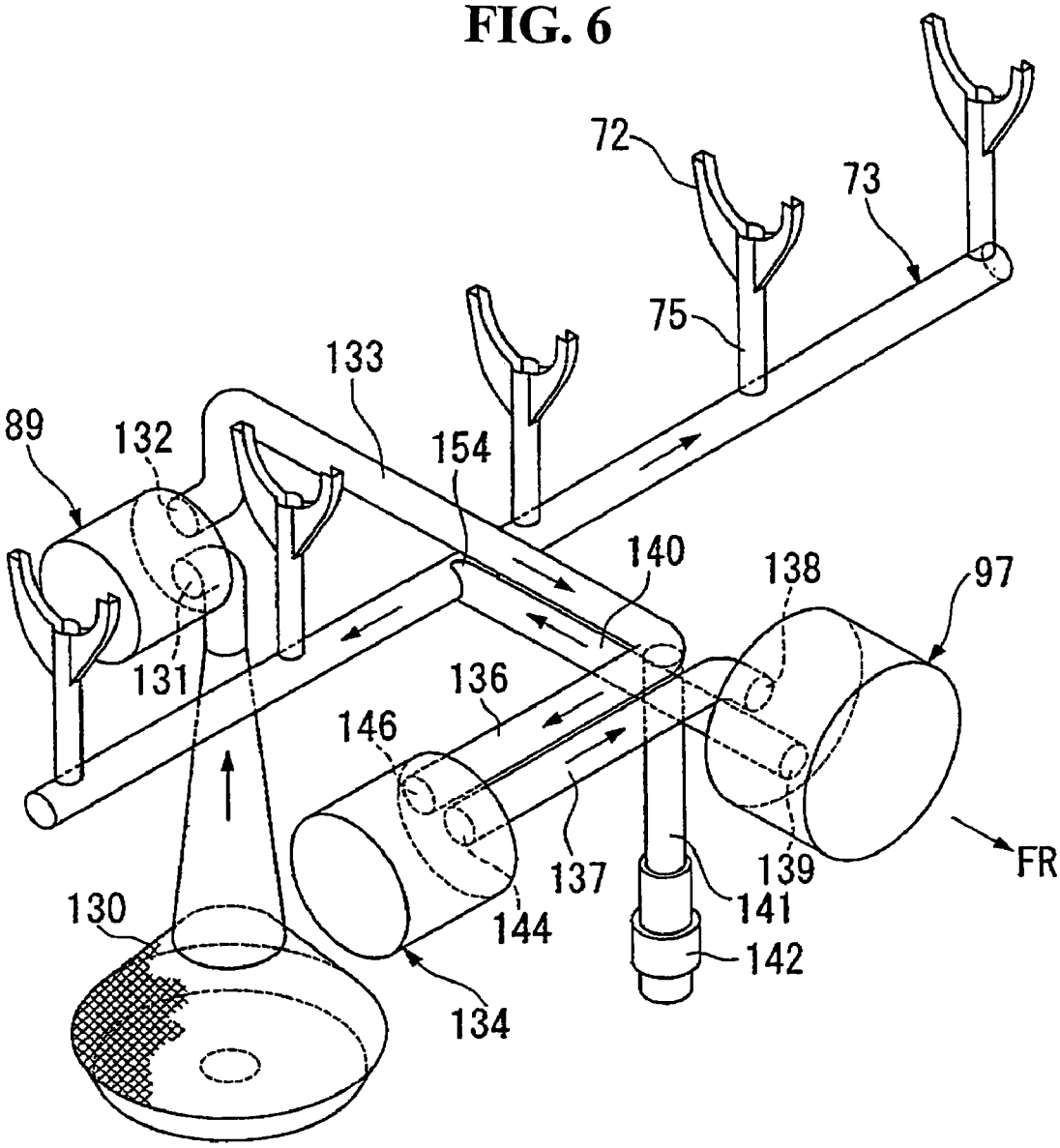
FIG. 6 is a perspective explanatory drawing for explaining a lubrication system of engine oil.

Referring to FIG. 6, the upper end of the oil strainer 130 is connected to an inlet 131 of the oil pump 89. An outlet 132 of the oil pump 89 is connected to a first oil passage 133 formed in the lower case 58. The first oil passage 133 is bent forward after it extends upward from the outlet 132 of the oil pump 89. The first oil passage is slightly lowered forward and is then extended forward. A holder 135 for attaching the cartridge type oil filter 134 so that the oil filter can be detached in the direction of the width of the body is provided to the right side of the front wall 96 of the lower case 58. An oil inflow path 136 extending to the inside in the direction of the width of the body from the holder 135 is provided. Furthermore, the front end of the first oil passage 133 is connected to the left end of the oil inflow path 136. In addition, an oil outflow path 137 is provided on the front wall 96 of the lower case 58 substantially in parallel with the oil inflow path in front of the oil inflow path 136. An inlet 138 of the oil cooler 97 is connected to the left end of the oil outflow path 137.

An outlet 139 of the oil cooler 97 is connected to a second oil passage 140 formed in the lower case 58. The second oil passage 140 is slightly raised backward substantially in parallel with the first oil passage 133 and is then extended backward. The second oil passage 140 communicates with an oil gallery (not shown) including the main oil gallery 73 in the body of the engine 15 and an oil jet (not shown). Engine oil sucked from the oil strainer 130 by the operation of the oil pump 89 is force-fed into the first oil passage 133, and is supplied to the body of the engine 15 from the second oil passage 140 after the engine oil is filtered in the oil filter 134 and is cooled in the oil cooler 97. In the main oil gallery 73, the taken-in engine oil is supplied to each journal supporter 71 from each oil path 74 and each oil groove 72. In FIG. 6, an arrow in each path shows a direction in which the engine oil flows and an arrow FR shows the front side of the body.

The engine oil supplied to the body of the engine 15 is returned to the oil pan 46 by a natural flow, is reserved there, and is repeatedly circulated in the body of the engine 15 passing the above-mentioned path. When the engine is rotated at a high speed, the oil pressure of the force-fed engine oil is increased. If the oil pressure reaches a predetermined value, an oil relief valve 142 is operated. The oil relief valve 142 is connected to the lower side of a part in which the first oil passage 133 and the oil inflow path 136 are crossed via a relief path 141. In this case, a part of the engine oil is returned to the oil pan 46, and the oil pressure in the path is adjusted.

The oil filter 134 is directly attached to the holder 135 from the right end of the body of the engine 15. The holder 135 is formed in a state in which the holder has the oil outflow path 137 substantially in the center. The right end face (the side of the lower case 58) is made so that it is substantially perpendicular to the width direction of the body to form a face 143 on which the oil filter 134 is mounted. An outflow opening 144 of the oil outflow path 137 is provided in the center of the mounting face 143. An annular oil groove 145 is formed in the circumference of the outflow opening 144. Furthermore, an inflow opening 146 of the oil inflow path 136 is provided at the bottom of the oil groove 145.

The oil filter 134 is an existing cartridge-type filter that houses a filter element 148 in a cylindrical case 147. The oil filter 134 has a bottom that closes an opening of the case 147 with a disc-like set plate 149. The filter element 148 is formed so that it is cylindrical by bending filter paper into a corrugated structure in the oil filter 134. Filtering is performed by passing engine oil from the outside of the filter element 148 to the inside. Ring sealing packing 150 is installed inside the opening of the case 147 to enable sealing when the oil filter 134 is attached to the holder 135.

A round hole 151 communicating with space inside the filter element 148 is formed in the center of the set plate 149. A female screw is formed on the inside circumference of the round hole 151. A nozzle 152 protruding in the direction of the width of the body from the mounting face 143 is provided to the outflow opening 144 of the holder 135. A male screw corresponding to the female screw of the round hole 151 is formed on the periphery of the nozzle 152. The oil filter 134 is attached to the holder 135 by fitting the round hole 152 to the nozzle 152 and press-fitting the oil filter 134 by turning it.

When the oil filter 134 is attached to the holder 135, the space inside the filter element 148 and the oil outflow path 137 communicate via the round hole 151 and the nozzle 152. Plural inflow holes 153 communicating with space outside the filter element 148 are formed around the round hole 151 of the set plate 149. The inflow holes 153 are arranged opposite to the oil groove 145 of the mounting face 143 when the oil filter 134 is attached. The oil inflow path 136 and the space outside the filter element 148 communicate via the oil groove 145 and the inflow holes 153.

The engine oil sent from the first oil passage 133 to the oil inflow path 136 flows into the oil filter 134 via the oil groove 145 and the inflow holes 153. The engine oil then passes from the space outside the filter element 148 to the space inside it and is filtered. The filtered engine oil is sent to the oil outflow path 137 via the round hole 151 and the nozzle 152 and is led to the oil cooler 97.

The oil cooler 97 has a cylindrical appearance. One end face of the oil cooler 97 is fixed to the front wall 96 of the lower case 58. The engine oil sent to the oil cooler 97 is led into the oil cooler 97 from the inlet 137 and is cooled by passing a predetermined path. The engine oil led from the outlet 139 to the second oil passage 140 is supplied to each part of the body of the engine 15 from the oil gallery and the oil jet. The engine oil supplied to the body of the engine 15 lubricates the crankshaft 60, the transmission 62, the clutch mechanism 63, the piston 65 and each camshaft 83, 84. The engine oil also buffers the body of the engine, improves the sealing of the engine 15 and the cools the body of the engine 15.

The oil cooler 97 is arranged in the vicinity of the center (on the slightly right side) in the direction of the width of the body. The second oil passage 140 is also arranged in the substantial center in the direction of the width of the body of the crankcase 41. The crankcase 41 and a center position in the direction of the width of the body of the crankshaft 60 and the main oil gallery 73 are close. The second oil passage 140 extends backward from the oil cooler 97 and is connected to a connection 154 in the substantial center in the direction of the width of the body of the main oil gallery 73. Therefore, the oil pressure of engine oil led to the main oil gallery 73 is substantially uniform and the engine oil is uniformly supplied in the direction of the width of the body.

The downward extended part 50 of each exhaust pipe 44 is slightly bent convexly forward in the vicinity of the vertical center as shown in FIGS. 2 and 3 in consideration of the layout with the oil cooler 97 provided to the side of the crankcase 41, the secondary balancer 85 and the oil filter 134. The downward extended parts 50*a* and 50*d* of the exhaust pipe 44*a* at the end of the left side and the exhaust pipe 44*d* at the end of the right side are bent like a crank when the lower part protrudes forward more than the upper part. Therefore, the downward extended part 50*d* of the exhaust pipe 44*d* and the oil filter 134 are arranged so that they are not overlapped when they are viewed from the front of the body of the engine 15 (see FIG. 2). That is, the downward extended part 50*d* of the exhaust pipe 44*d* at the end of the right side is arranged inside the oil filter in the direction of the width of the body so that the downward extended part is not longitudinally overlapped with the oil filter 134.

Therefore, a tool for detaching the oil filter 134 can be used without interfering with the exhaust pipe 44*d*. Similarly, the oil filter 134 can be easily held by hand. The downward extended part 50*d* of the exhaust pipe 44*d* extends backward under the crankcase 41 after it avoids the oil filter 134. Therefore, no exhaust pipe is arranged under the oil filter 134 and the exhaust pipe is prevented from being contaminated by engine oil dropped when the oil filter 134 is detached.

As described above, the crankcase 41 is vertically partitioned into the upper case 57 ranging to the body of the cylinder 40 and the lower case 58. The axis C, which is the rotational axis of the crankshaft 60, is arranged on the partition face S of the crankcase 41. The partition face S of the crankcase 41 is substantially perpendicular to the axis T of each cylinder 64 arranged in a forward inclined posture. Furthermore, a pair of journal supporters 71 is provided on the upper case 57 and the lower case 58 (see FIG. 3).

Figure 8:
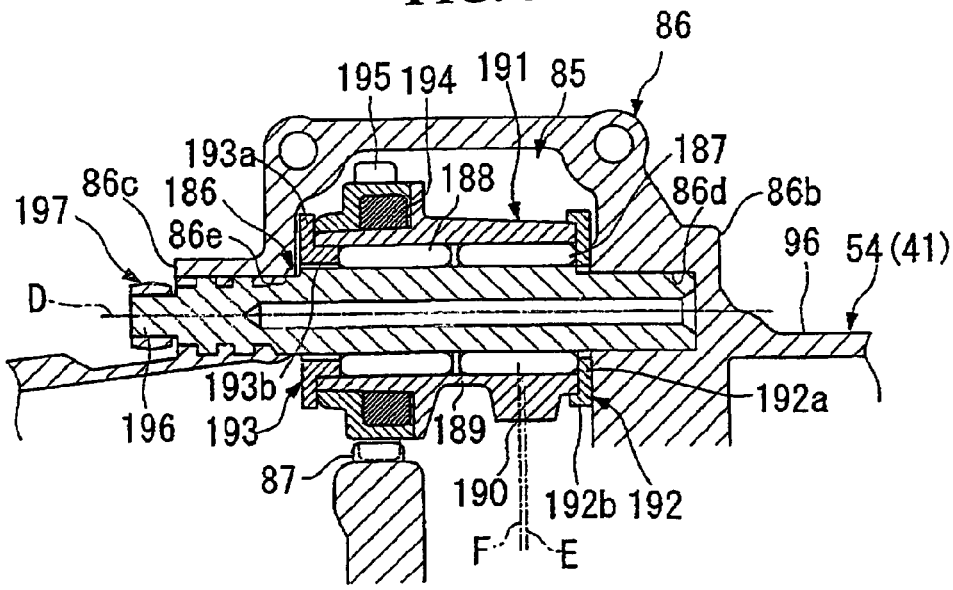
FIG. 8 is an enlarged view showing a main part of a part shown in FIG. 4.

As shown in FIG. 8, the secondary balancer 85 is provided with a balancer shaft 186 between right and left side walls 86*b*, 86*c* of the housing 86. A pair of needle bearings 187 and 188 is installed on the periphery of the balancer shaft 186 between both side walls 86*b* and 86*c*. A balancer weight 191 has a cylindrical part 189 supported by the balancer shaft 186 via each needle bearing 187 and 188 and a weight 190 is formed at the right end. Thrust washers 192 and 193 are arranged at the right end and at the left end of the balancer weight 191 and a balancer driven gear 195 is attached to the left end of the balancer weight 191 via damper rubber 194. The balancer driven gear 195 is engaged with the balancer drive gear 87 of the crankshaft 60 and the secondary balancer 85 is rotated together with the crankshaft 60.

The balancer shaft 186 is supported on an axis D by a right supporter 86*d* configured by a through hole formed in the right side wall 86*b* of the housing 86 and a left supporter 86*e* configured by a dead-end hole formed in the left side wall 86*c* of the housing 86. The outside end 196 protruded from the left supporter 86*e* toward the outside of the housing 86 of the balancer shaft 186 is fixed via a fixing member 197. The fixing member 197 fixes the balancer shaft 186 to the left side wall 86*c* of the housing 86 in a state in which the rotation and the axial movement of the balancer shaft 186 are regulated. One end of the fixing member 197 is fastened to the outside end 196 of the balancer shaft 186 by a bolt and others. Furthermore, the other end is attached to a left boss 198 (see FIG. 9) of the housing 86.

The balancer shaft 186 is eccentric between the right and left supporters 86*d*, 86*e*. Turning the outside end 196 by a tool, for example, can vary the phase of an eccentric part 199. The balancer weight 191 is supported by the periphery of the eccentric part 199 via a pair of needle bearings 187 and 188 so that the balancer weight can be rotated and the balancer drive gear 195 can be moved in parallel together with the balancer weight 191 by varying the phase of the eccentric part 199.

Backlash between the balancer driven gear 195 and the balancer drive gear 87 can be adjusted by releasing the fixation of the balancer shaft 186 by the fixing member 197 and moving the balancer driven gear 195 in parallel by varying the phase of the eccentric part 199 as described above. Noise and vibration by the engagement of each gear can therefore be minimized. The weight 190 of the balancer weight 191 and the balancer driven gear 195 are made separate in an axial direction so as to avoid interference with the big end of the connecting rod 56.

The thrust washers 192 and 193 are arranged between both ends of the balancer weight 191 and both side walls 86*b* and 86*c* of the housing 86. The thrust washer 192 arranged on the right side is provided with an annular cylindrical holding part 192*b*, which extends to the side of the balancer weight 191 on the periphery of the body 192*a*. The thrust washer 192 is positioned for the balancer weight 191 by supporting a thrust force with the inner surface of the side wall 86*b* on the right surface of the body 192*a*, supporting the thrust force between the right end of the balancer weight 191 and the needle bearing 187 on the left surface of the body 192*a* and further, fitting the inner face of the cylindrical holding part 192*b* to the peripheral face of the right end of the balancer weight 191.

The thrust washer 193 arranged on the left side of the balancer weight 191 is provided with an annular cylindrical holding part 193*b* extended to the side of the balancer weight 191 on the inner surface of the body 193*a*. The thrust washer 193 is positioned for the balancer weight 191 by supporting the thrust force with the inner surface of the side wall 86*c* on the left surface of the body 193*a*, holding the thrust force between the left end of the balancer weight 191 and the left end of the balancer driven gear 195 on the right surface of the body 193*a*, supporting the thrust force with the needle bearing 188 by the right end of the cylindrical holding part 193*b* and further, fitting the peripheral face of the cylindrical holding part 193*b* to the inner surface of the left end of the balancer weight 191.

The cylindrical holding part 192*b* of the right thrust washer 192 is formed on the periphery of the body 192*a*. Therefore, the needle bearing 187 can be arranged on the side of the body 192*a* (on the right side) without interfering with the cylindrical holding part 192*b*. As a result, an intermediate position F in an axial direction of the needle bearing 187 is brought close to an intermediate position E in an axial direction passing a center of gravity of the weight 190 located on the right side of the balancer weight 191, and displacement in an axial direction between both intermediate positions can be minimized. Therefore, an offset load applied to the needle bearing 187 is reduced and the durability can be enhanced.

Referring to FIG. 4, the housing 86 of the secondary balancer 85 is provided between the second journal supporter 71*b* from the left in the direction of the width of the body and the inside journal supporter 71*c*. The right and left side walls 86*b* and 86*c* of the housing 86 and each journal supporter 71*c* and 71*b* are formed so that respective pairs range, and the rigidity of the housing 86 and the crankcase 41 is enhanced. Therefore, the lower case 58 can support a centrifugal force applied to the secondary balancer 85 without special reinforcement. The fastening bolt 155 integrates the front side and the rear side of the journal supporter 71. Therefore, rigidity for supporting the secondary balancer 85 is more enhanced and the increase of the weight of the lower case 58 is inhibited.

Furthermore, the fastening bolt 155 made of steel having a Young's modulus, which is higher than that of an aluminum alloy, which is the material of the crankcase 41, fastens each journal supporter 71. Therefore, a rigidity for coupling the crankcase 41 is enhanced by the fastening force of the fastening bolt 155. Therefore, the vibratory force (the damping force that inhibits the vibration of the crankshaft 60) of the secondary balancer 85 effectively acts and the vibration of the engine can be minimized.

Figure 9:
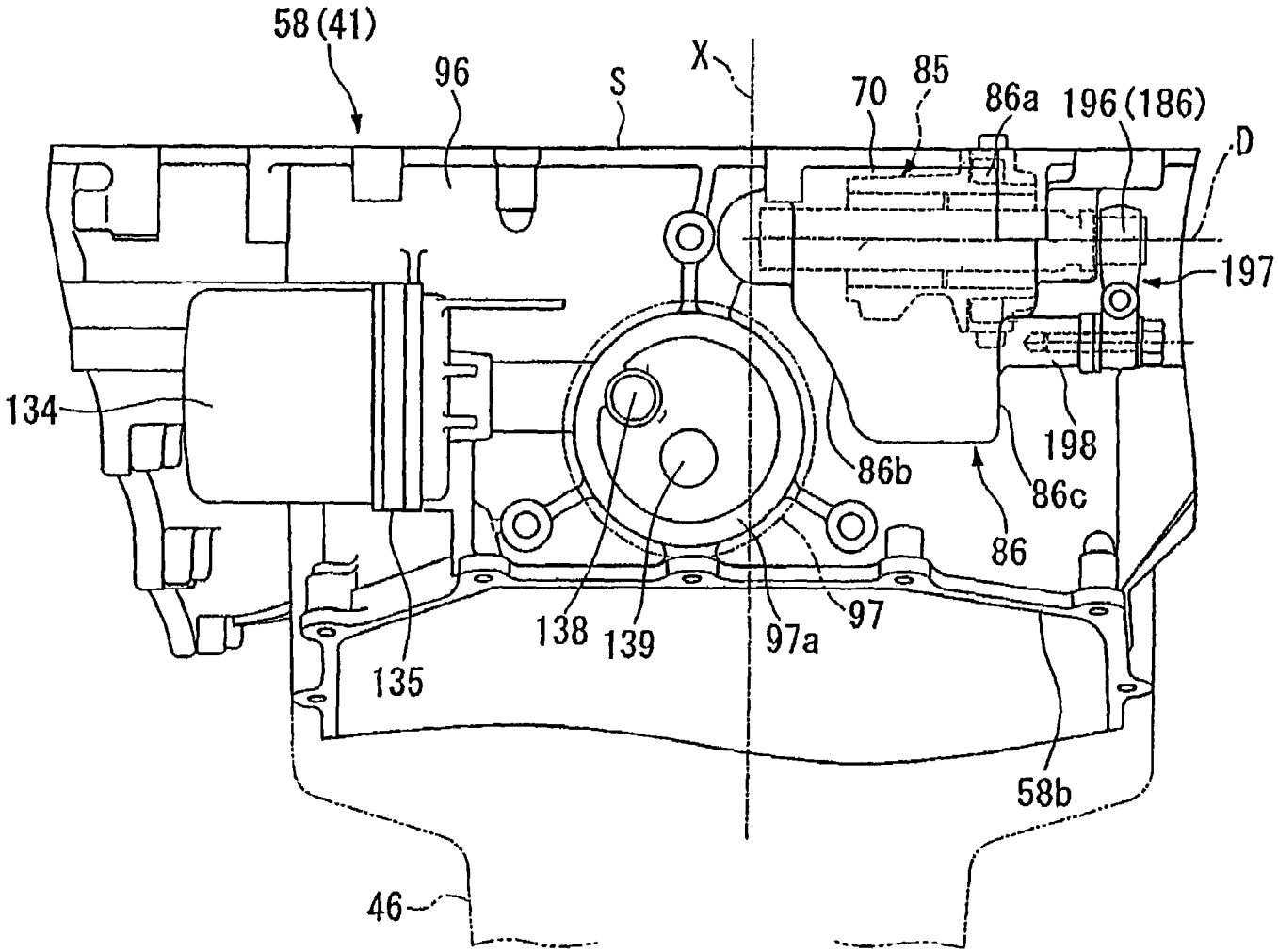
FIG. 9 is a front explanatory drawing when the lower case is viewed from a direction perpendicular to its front wall.

As shown in FIG. 9, the housing 86 of the secondary balancer 85 is arranged so that it is adjacent to a left upper part of the cylindrical oil cooler 97. Therefore, the shape of a lower part of the right side wall 86*b* of the housing 86 is differentiated from the shape of the left side to avoid the left upper part of the oil cooler 97. The shape of the upper edge on the partition face S of the side wall 86*b* is inclined leftward toward the front (see FIG. 4). In this case, the oil cooler 97 and its attachment 97*a* are arranged in the vicinity (the vicinity of the lower opening 58*b* in FIG. 9) of the lower case lower wall 58*a*, which is the lower side of the lower case 58. That is, the secondary balancer 85 arranged on the upside of the lower case 58 and the oil cooler 97 arranged on the lower side of the lower case 58 are arranged in the vicinity of the center X in the direction of the width of the body so that a part of these is overlapped in the direction of the width of the body.

The oil filter 134 and its holder 135 are arranged substantially at the same level as the oil cooler 97 and its attachment 97*a*. That is, the bending of the oil passage of the engine oil is minimized, the flow of the oil is smoothed, the formation of the oil passage is facilitated and the productivity of the lower case 58 is enhanced. The oil filter 134 is directly attached to the side of the lower case 58 formed by the holder 135.

According to the above-mentioned embodiment, the oil filter 134, the oil cooler 97 and the secondary balancer 85 are collectively arranged in the lower case 58, the center of gravity of the engine is lowered, the engine is miniaturized and heavy masses can be concentrated. Therefore, the maneuverability of the vehicle and a degree of the freedom of the body layout can be enhanced. In addition, the oil filter 134 and the oil cooler 97 are separately arranged. Therefore, a degree of freedom of the layout can be enhanced, compared with a situation where the oil cooler 97 and the oil filter 134 are arranged in series.

The oil cooler 97 and the secondary balancer 85 are arranged at the back of the exhaust pipe 44 passing the front side of the crankcase 41. Therefore, the configuration of the oil passage is simplified, compared with a case that an air-cooled oil cooler for example is arranged in front of the exhaust pipe 44 and communicates with the crankcase 41 via an oil hole and others, and in case the water-cooled oil cooler 7 is adopted as in the embodiment, a cooling water channel can be also simplified. Therefore, the number of manufacturing man-hours and the cost can be reduced by the simplification of the configuration of the components. In addition, it is suitable for the drive of the secondary balancer 85 and the collective arrangement of each component that the secondary balancer 85 is arranged in the front of the lower case 58.

Furthermore, the secondary balancer 85 is arranged in front of the fastening bolt 155 for fastening each journal supporter 71 on the side of the upper case 57 and on the side of the lower case 58. Therefore, the secondary balancer 85 can be arranged in the vicinity of the partition face S of the crankcase 41, avoiding the circumference of the journal supporter 71 of the lower case 58, that is, in the part close to the upside of the lower case 58. Therefore, the consumption of engine oil by the secondary balancer 85 is minimized. In addition, the friction loss of the engine is reduced, the output of the engine is enhanced and fuel economy can be reduced. Particularly, since the secondary balancer 85 is rotated at twice the number of revolutions of the crankshaft 60, great effect is acquired.

The oil filter 134 is directly attached to the side of the lower case 58. Therefore, the oil filter 134 can be detached in the direction of the width of the body from the side end of the body of the engine 15. Furthermore, even if the exhaust pipe 44 is arranged in front of the crankcase 41, the exhaust pipe 44 does not prevent the detachment of the oil filter 134 and the maintainability can be enhanced.

The invention is not limited to the embodiment and for example, the oil filter 134 may also be attached to a part other than the side of the lower case 58. In addition, the invention can be also applied to the case of a biaxial secondary balancer and a primary balancer. Furthermore, the type of engine is not limited to an in-line four-cylinder engine, can be applied to engines of various types provided with a balancer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine crankcase structure, comprising:

a crankcase, said crankcase being vertically partitioned into an upper case and a lower case;

a plurality of journal supporters, each of said plurality of journal supporters being formed in the upper case and in the lower case so that a rotational axis of a crankshaft of the engine is arranged in parallel with a width direction of a body of the engine on a partition face of the crankcase, the crankshaft being supported for rotation by the plurality of journal supporters;

an oil filter, said oil filter being directly attached to the lower case; and an oil cooler and a balancer, said oil cooler and said balancer being arranged in front of the lower case.

2. The engine crankcase structure according to claim 1, wherein the oil cooler and the balancer are arranged behind an exhaust pipe that passes in front of the crankcase.

3. The engine crankcase structure according to claim 1, wherein the balancer is arranged in front of fastening bolts for fastening each of the plurality of journal supporters, the fastening bolts being located on a side of the upper case and on a side of the lower case.

4. The engine crankcase structure according to claim 2, wherein the balancer is arranged in front of fastening bolts for fastening each of the plurality of journal supporters, the fastening bolts being located on a side of the upper case and on a side of the lower case.

5. The engine crankcase structure according to any of claim 1, wherein an oil filter is directly attached to a side of the lower case.

6. The engine crankcase structure according to any of claim 2, wherein an oil filter is directly attached to a side of the lower case.

7. The engine crankcase structure according to any of claim 3, wherein an oil filter is directly attached to a side of the lower case.

8. The engine crankcase structure according to any of claim 4, wherein an oil filter is directly attached to a side of the lower case.

9. An engine, comprising:

a cylinder head;

a cylinder block attached to the cylinder head;

a crankcase attached to the cylinder block, said crankcase including an upper case and a lower case connected to each other at a partition face;

a crankshaft supported for rotation in the crankcase so that a rotational axis of the crankshaft is co-planar with the partition face;

an oil filter, said oil filter being directly attached to the lower case; and an oil cooler and a balancer, said oil cooler and said balancer being arranged in front of the lower case.

10. The engine according to claim 9, wherein the oil cooler and the balancer are arranged behind an exhaust pipe that passes in front of the crankcase.

11. The engine according to claim 9, wherein the balancer is arranged in front of fastening bolts for fastening each of the plurality of journal supporters, the fastening bolts being located on a side of the upper case and on a side of the lower case.

12. The engine according to claim 10, wherein the balancer is arranged in front of fastening bolts for fastening each of the plurality of journal supporters, the fastening bolts being located on a side of the upper case and on a side of the lower case.

13. The engine according to any of claim 9, wherein an oil filter is directly attached to a side of the lower case.

14. The engine according to any of claim 10, wherein an oil filter is directly attached to a side of the lower case.

15. The engine according to any of claim 11, wherein an oil filter is directly attached to a side of the lower case.

16. The engine according to any of claim 12, wherein an oil filter is directly attached to a side of the lower case.

* * * * *